US009064669B2

(12) United States Patent
Liu et al.

(10) Patent No.: US 9,064,669 B2
(45) Date of Patent: Jun. 23, 2015

(54) FIELD EMISSION CATHODE AND FIELD EMISSION LIGHT USING THE SAME

(71) Applicant: National Defense University, Bade, Taoyuan County (TW)

(72) Inventors: Yih-Ming Liu, Zhongli (TW); Meng-Jey Youh, Taoyuan (TW); Nen-Wen Pu, Longtan Township, Taoyuan County (TW); Ming-Der Ger, Daxi Township, Taoyuan County (TW); Kevin Cheng, Pingzhen (TW); Kun-Ju Chung, Chaozhou Township, Pingtung County (TW); Jhih-Cheng Jiang, Sanxing Township, Yilan County (TW); Guan-Fang Xu, Guanyin Township, Taoyuan County (TW)

(73) Assignee: NATIONAL DEFENSE UNIVERSITY, Bade, Taoyuan County (TW)

( * ) Notice: Subject to any disclaimer, the term of this patent is extended or adjusted under 35 U.S.C. 154(b) by 210 days.

(21) Appl. No.: 13/942,092

(22) Filed: Jul. 15, 2013

(65) Prior Publication Data

US 2015/0015166 A1 Jan. 15, 2015

(51) Int. Cl.
*H01J 1/304* (2006.01)
*H01J 63/06* (2006.01)

(52) U.S. Cl.
CPC *H01J 1/304* (2013.01); *H01J 63/06* (2013.01)

(58) Field of Classification Search
USPC ..... 315/340
See application file for complete search history.

(56) References Cited

U.S. PATENT DOCUMENTS 7,195,938 B2 * 3/2007 Yaniv et al. ..... 438/20
7,372,193 B2 * 5/2008 Hirokado ..... 313/310
7,393,699 B2 * 7/2008 Tran ..... 438/1

(Continued)

FOREIGN PATENT DOCUMENTS

TW 201133533 10/2011

OTHER PUBLICATIONS

Lee, Sora et al., Effect of degassed elements on the degradation behavior of carbon nanotube cathodes in sealed field emission-backlight units, Applied Physics Letters, 2006, pp. 063502-1-063502-3.

(Continued)

*Primary Examiner* — Douglas W Owens
*Assistant Examiner* — Srinivas Sathiraju
(74) *Attorney, Agent, or Firm* — Muncy, Geissler, Olds & Lowe, P.C.

(57) ABSTRACT

A field emission cathode comprises at least one electron emitting parcel, and at least one ion absorbing parcel each being electrically connected with each of the at least one electron emitting parcel. The electron emitting parcel includes a first substrate and a nano emission component disposed on the first substrate for emitting electrons in an electric field. The ion absorbing parcel is constituted by a second substrate, in which the electric conductivity of the first substrate is less than that of the second substrate. A field emission light comprises the said field emission cathode, a field emission anode and a power supply. Thus the positive ions in an electric field can be absorbed by ion absorbing parcels to suppress an ion bombardment in the electric field. The efficiency of the electric field of the field emission is then maintained, and the lifetime of the field emission light is enhanced.

9 Claims, 10 Drawing Sheets

(56) References Cited

U.S. PATENT DOCUMENTS

| | | | | |
|---|---|---|---|---|
| 7,466,071 | B2 * | 12/2008 | Oh et al. | 313/495 |
| 7,492,088 | B2 * | 2/2009 | Jang et al. | 313/496 |
| 7,528,538 | B2 * | 5/2009 | Kitamura et al. | 313/495 |
| 7,545,090 | B2 * | 6/2009 | Han et al. | 313/495 |
| 7,585,199 | B2 * | 9/2009 | Takai | 445/51 |
| 7,648,406 | B2 * | 1/2010 | Tai et al. | 445/50 |
| 7,687,981 | B2 * | 3/2010 | Parsapour | 313/311 |
| 7,741,765 | B2 * | 6/2010 | Liu et al. | 313/311 |
| 7,906,971 | B2 | 3/2011 | Boardwine et al. | |
| 7,960,904 | B2 * | 6/2011 | Takai et al. | 313/311 |
| 7,999,453 | B2 * | 8/2011 | Ishida | 313/309 |
| 8,004,167 | B2 * | 8/2011 | Ishida et al. | 313/311 |
| 8,169,223 | B2 | 5/2012 | Xiao et al. | |
| 8,228,308 | B2 * | 7/2012 | Jiang et al. | 345/173 |
| 8,339,022 | B2 * | 12/2012 | Wei et al. | 313/311 |
| 8,390,580 | B2 * | 3/2013 | Jiang et al. | 345/173 |
| 8,411,051 | B2 * | 4/2013 | Jiang et al. | 345/173 |
| 8,411,052 | B2 * | 4/2013 | Jiang et al. | 345/173 |
| 8,421,327 | B2 * | 4/2013 | Wei et al. | 313/311 |
| 8,513,870 | B2 * | 8/2013 | Lee et al. | 313/496 |
| 8,767,159 | B2 * | 7/2014 | Kimura | 349/144 |
| 8,847,476 | B2 * | 9/2014 | Wang | 313/498 |
| 8,986,782 | B2 * | 3/2015 | Ho et al. | 427/248.1 |
| 2003/0090190 | A1 * | 5/2003 | Takai et al. | 313/311 |
| 2005/0275331 | A1 * | 12/2005 | Takai et al. | 313/311 |
| 2006/0001350 | A1 * | 1/2006 | Fujieda et al. | 313/441 |
| 2007/0170414 | A1 * | 7/2007 | Takai et al. | 257/9 |
| 2007/0285843 | A1 * | 12/2007 | Tran | 360/245.9 |
| 2008/0169745 | A1 * | 7/2008 | Tolt | 313/310 |
| 2008/0203884 | A1 * | 8/2008 | Zheng et al. | 313/309 |
| 2008/0203886 | A1 * | 8/2008 | Takai et al. | 313/311 |
| 2009/0039754 | A1 * | 2/2009 | Tolt | 313/310 |
| 2009/0072750 | A1 * | 3/2009 | Akinwande et al. | 315/169.1 |
| 2012/0306348 | A1 * | 12/2012 | Jeong et al. | 313/310 |
| 2014/0055027 | A1 * | 2/2014 | Ger et al. | 313/496 |
| 2014/0111081 | A1 * | 4/2014 | Jeong et al. | 313/346 R |
| 2014/0291609 | A1 * | 10/2014 | Wang et al. | 257/10 |

OTHER PUBLICATIONS

Itoh, S. et al., Influences of gases on the field emission, Journal of Vacuum Science and Technology B, 1993, pp. 647-650.

* cited by examiner

FIELD EMISSION CATHODE AND FIELD EMISSION LIGHT USING THE SAME

FIELD OF THE INVENTION

The present invention relates to a field emission cathode and a field emission light using the same, by an ion absorbing parcel of the field emission cathode, positive ions in an electric field can be absorbed to suppress an ion bombardment in the electric field, the efficiency of the electric field of the field emission is then maintained, and the lifetime of the field emission light is enhanced.

BACKGROUND OF THE INVENTION

The first generation of luminaire, which is the well-known traditional incandescent bulb with excessive energy consumption, has gradually been banned by many governments across the world. The second generation of luminaire, which mainly refers to a fluorescent lamp, energy saving halogen bulbs (such as Compact fluorescent lamp; CFL), mercury lamp and so on, emits light beams based on exciting the phosphor power by X (or UV) rays generated by exciting mercury or halogen vapor encapsulated in a vacuum glass container using electrons. Because such luminaire contains mercury or halogen which brings a great negative impact on our environment, it has gradually been replaced by other eco-friendly luminaire too. The third generation of luminaire, which is also called solid-state lighting, mainly refers to use an LED (or OLED) as a light source to constitute a luminaire; however, only 20% to 30% of total energy input into either the LED or the OLED can be converted to light, and the remaining (70% to 80%) of total energy is consumed as thermal energy. In other words, luminous efficiency of the solid-state light source is insufficient. Moreover, the LED (or OLED) is manufactured by a semiconductor manufacturing process, which consumes enormous resources and includes use of toxic chemicals; therefore, it is not truly meet the environmental requirement of human beings.

Since field emission theory can also convert electrical energy to light, the development of field emission light sources to be the fourth generation of luminaire is increasingly taken seriously. As shown in FIG. 1, a field emission light 90 includes a field emission cathode element 93 and a field emission anode element 92 both packed in a vacuum chamber 91 of a glass container. By applying an electric voltage through power supply 95 to the field emission light 90, an electric field is established. An electron beam emitted by the field emission cathode element 93 excites a fluorescent powder on the field emission anode element 92 to emit light, which has a luminous efficiency up to 40 lumen to 60 lumen per watt or more. In particular, the field emission light can be simpler and more energy-saving compared to the semiconductor manufacturing process, and may improve human illumination if fully developed.

The field emission theory was first developed by R. H. Fowler and L. W. Nordheim in 1928; in the situation of applying an additional electric field between the field emission cathode and the field emission anode, electrons on the field emission cathode may tunnel out of the potential barrier. Researches devote their efforts to develop many fields in emission cathode material for the field emission cathode element 93 to achieve better field emission effect and longer service life. Materials can be used in the field emission cathode developed from a cathode plate with outgrowing spikes, to carbon nanotubes (CNTs)931 or nano zinc oxide materials used nowadays. These structures or materials used nowadays have high aspect ratio, thereby generating greater field emission enhancing factors for enhancing field emission.

Carbon nanotubes are single or multiple layered nano scaled graphite sheets forming a hollow cylindrical structure. Because of the small diameter and the large aspect ratio of the carbon nanotube, hundreds to thousands times of locally enhanced electric field can be generated at the tip of the carbon nanotube, so that electrons can be emitted with an electric field of 1~2 V/μm from the CNT by overcoming a work function of 4.5 eV, which offers an excellent electron-emitting effect and can be applied to field emission lights in the light emitting field. When the carbon nanotube is disposed at the field emission cathode in an electric field, electrons can be emitted from the tips of the CNT by the driving force of the electric field. Thereafter, the electrons will collide with phosphor powder on the field emission anode through a vacuum interval, thereby a light beam is emitted based on the field emission light theory. The field emission light theory can be applied for developing field emission lights (FELs), and field emission displays (FEDs) and other light source devices.

In summary, a field emission lighting system emits light based on electrons emitted from a field emission cathode collide with a field emission anode in a electric field in a vacuum environment; however, in the manufacturing and packaging process for both the field emission cathode and anode, unwanted substances like water vapor, air or bonder may remain on them. In the vacuum environment, these unwanted substances will be gradually released to be an outgas formed the positive ions and the negative ions after collided by electron from field emission cathode, in which the positive ions will move toward the field emission cathode affected by the negative potential of the field emission cathode with very fast driving velocity, thereby causing a phenomenon of ion bombardment to damage the surface of the field emission cathode. What is more, a plasma phenomenon occurs when the ion concentration gets higher, thereby destroying the electric field as well as damaging the field emission lighting device.

In a conventional vacuum electric field system, such as an ionization gauge, an ion collector is frequently used to determine the amount of ions, or to remove ions in an electric field, as described in U.S. Pat. No. 8,169,223, U.S. Pat. No. 7,906,971, or TW Pub. No. 201133533. In details, ions generated by the outgas will be accelerated by the voltage of both the field emission anode and cathode, thereby causing ion bombardment on the field emission anode or cathode. A gate electrode is added out of the electric field between the field emission cathode and the field emission anode to collect the ions for reducing the ions being bombarded by the electrons emitted from the field emission cathode. Therefore, the gate electrode prevents a phenomenon of ions sputtering on the field emission cathode or anode, thereby protect the field emission cathode or anode from perforation or damage by the ions. However, the gate electrode requires an additional power supply with different voltage, such that the complexity of the power supply, the assembly difficulty of a field emission lamp and the cost will increase. Furthermore, arranging the gate electrode in the field emission lamp out of (or into) the electric field between the field emission cathode and anode will shield light emitted by the field emission anode, resulting in insufficient illumination of the field emission lamp, thereby limiting the use of field emission light.

The field emission anode in a field emission lighting mainly contains a conductive metal layer and a phosphor mixed by bonding agent, no matter how much a degree of vacuum is in the manufacturing process of the field emission lighting, after the field emission lighting is packaged and a time period after lighting, the field emission anode will release hydrogen molecules, water molecules, zinc, sulfur, silicon, bonder, etc. For instance, a paper published by Sora Leea and Duk Young Jeon in 2006, Applied Physics Letters 88, "Effect of degassed elements on the degradation behavior of carbon nanotube cathodes in sealed field emission-backlight units" illustrates that the field emission anode of a field emission backlight releases outgas containing sulfur and zinc. Moreover, the field emission cathode mainly includes carbon nanotubes, which absorb water, nitrogen and oxygen and so on if it is exposed to air before packaging. After a period of time after the light activating, the field emission cathode will release water molecules, hydrogen, carbon, nitrogen, oxygen, etc.; although these substances can be partially removed by the use of vacuum in the package process of the field emission lighting, during the field emission lighting being lightened, these substances will continue to be released, and be bombarded by the electrons emitted from the field emission cathode, resulting in generating unwanted ions that causes the phenomenon of ion bombardment, thereby reducing the brightness of the field emission lighting and even its lifetime. Such phenomenon was provided in a paper published by S. Itoh, T. Niiyama and M. Yokoyama in 1993, J. Vac. Sci. Technol. B11, 647, "Influences of gases on the field emission". Therefore, how to remove the ions derived from these substances is the issue that urgently needs to be solved in the field emission lighting.

SUMMARY OF THE INVENTION

In view of such problems in those conventional arts, the present invention proposes a field emission cathode mainly applied for a field emission light based on the field emission theory, such as a field emission light bulb (FEL bulb), a field emission light tube (FEL tube), a field emission light panel (FEL panel), or a field emission display (FED), etc. The field emission cathode comprises at least one electron emitting parcel, and at least one ion absorbing parcel, in which each of the at least one electron emitting parcel is electrically connected with each of the at least one ion absorbing parcel.

In the field emission cathode, the electron emitting parcel comprises a first substrate being a conductive material and a nano emission component being made of a nano material and on the first substrate by coating, laying or germinating for emitting electrons in an electric field of the field emission light. For different applications, the nano emission component can be carbon nano tube (CNT), single-wall CNT, graphene, carbon nano fiber (CNF), coli-CNF, coli-CNT, nano graphite, carbon nano-horn, carbon nano-filament wall, fullerene, nano diamond-like carbon, nano metal particle or nano metal oxide (such as nano-ZnO), etc., but is not limited thereto.

Wherein the ion absorbing parcel is constituted by a second substrate made of a conductive material; in which the electric conductivity of the first substrate is less than the electric conductivity of the second substrate. As the electron emitting parcel and the ion absorbing parcel are electrically connected each other, the field emission cathode is at a negative potential relative to the field emission anode in the electric field, in which a surface voltage of the electron emitting parcel is slightly higher than a surface voltage of the ion absorbing parcel. For example, the surface voltage of the electron emitting parcel relative to the field emission anode may be −5,000 V; and the surface voltage of the ion absorbing parcel relative to the field emission anode may be −5,050 V, for example but not limited. For applications using different material, the surface voltage of the electron emitting parcel relative to the field emission anode and the surface voltage of the ion absorbing parcel relative to the field emission anode can be different values and combinations. Therefore, ionizing positive ions in the electric field will be absorbed by and bombard on the ion absorbing parcel preferentially, thereby preventing the electron emitting parcel being bombarded by the ionizing positive ions, and reducing the ionizing positive ions damaging the nano emission components.

Furthermore, the at least one ion absorbing parcel is generally spaced and adjacent to the at least one electron emitting parcel each other, or, deposed in spiral around each other or a combination thereof.

In the field emission cathode of this invention, in order to obtain a better electric property, the electric conductivity of the first substrate can be less than the electric conductivity of the second substrate. For example, the first substrate may be made of chromium oxide, conductive ceramic, passivated treatment stainless steel, graphite, diamond-like carbon or combinations thereof; the second substrate material may be made of chromium carbide, nickel, noble metal (such as silver, gold, palladium, and platinum), alloy containing iron and nickel (such as iron-cobalt-nickel alloy, and stainless steel), copper or combinations thereof.

Moreover, to maintain the efficiency of the field emission cathode, a total surface area of the ion absorbing parcel is less than or equal to a total surface area of the electron emitting parcel, that is, in an emission direction of the electrons, a cross-section length of each of the ion absorbing parcel is less than or equal to a cross-section length of the electron emitting parcel adjacent to the corresponding ion absorbing parcel.

According to another aspect of the present disclosure, a field emission light is provided and includes the aforementioned field emission cathode, a field emission anode and a power supply. The field emission cathode and the field emission anode are packaged in a glass vacuum chamber; the field emission cathode and the field emission anode are spaced by a vacuum gap. When the power supply applies a positive potential to the field emission anode and a negative potential to the field emission cathode, respectively, the field emission cathode and the field emission anode constitute an electric field for field emission.

Further, when the power supply applies the aforementioned voltage to the field emission anode and the field emission cathode, the surface voltage of the ion absorbing parcel is less than the surface voltage of the electron emitting parcel, thereby the ion absorbing parcel can absorb ionizing positive ions in the glass vacuum chamber. Therefore, the ionizing positive ions in the electric field will be absorbed by and bombard on the ion absorbing parcel preferentially, thereby preventing the ionizing positive ions bombarding and damaging the electron emitting parcel.

Furthermore, to maintain the efficiency of the field emission cathode in the field emission light, a total surface area of the ion absorbing parcel is less than or equal to a total surface area of the electron emitting parcel, that is, in an emission direction of the electrons, a cross-section length of each of the ion absorbing parcel is less than or equal to a cross-section length of the electron emitting parcel adjacent to the corresponding ion absorbing parcel.

In the present disclosure, the field emission light can have a bulb-like profile to be the FEL bulb, or can have a tube-like profile to be the FEL tube. By the ion absorbing parcel of the field emission cathode, the ionizing positive ions in the FEL bulb or tube can be absorbed, thereby maintaining a degree of vacuum as well as reducing the phenomenon of ion bombardment. Further, an amount of the field emission cathode is more than one, and an amount of the field emission anode can be at least one; the field emission light can be a FEL panel having a planar shape. The field emission anode can contain a plurality of recess each for accommodating each of the field emission cathodes. Based on the same reason, the ion absorbing parcel of the field emission cathode can absorb the ionizing positive ions in the FEL panel.

In conclusion, the field emission cathode and the field emission light using the same according to the present invention may have one or more advantages listed below:

(1) Since the electron emitting parcel and the ion absorbing parcel are electrically connected each other, the field emission cathode is at a negative potential relative to the field emission anode in the electric field, in which a surface voltage of the electron emitting parcel is slightly higher than a surface voltage of the ion absorbing parcel. Therefore, the ionizing positive ions in the electric field will be absorbed by and bombard on the ion absorbing parcel preferentially, thereby preventing the electron emitting parcel being bombarded by the ionizing positive ions.

(2) By disposing the ion absorbing parcel in the field emission cathode, the ionizing positive ions in the glass vacuum chamber can be absorbed, thereby maintaining the degree of vacuum of the vacuum chamber of the field emission light, the luminance of light emitted by the field emission light, and increasing the half-life of the field emission light.

(3) In the package process for a conventional field emission light, in order to reduce the vacuum value of the vacuum chamber, the gas in the field emission cathode and the field emission anode is evacuated by high temperature heating, prolonging the evacuation time, and heating then vacuuming repeatedly. However, such process takes a long time, and the effect is limited. With the field emission cathode and the field emission light using the same according to the present invention, the repeat count of heating then vacuuming can be reduced. Moreover, the ion absorbing parcel can absorb unwanted ions in the vacuum chamber during the field emission light emitting light, thereby maintaining the degree of vacuum of the chamber.

(4) In order to maintain a high degree of vacuum, a conventional vacuum system, such as ionization gauge, frequently installed with an extremely complicated ion collector, which requires additional power supply to apply an electric field to the ion collector field and power to the gate electrode. However, to meet the requirement of thinner and cost saving, such ion collector is inappropriate to install into the field emission light. With the field emission cathode and the field emission light using the same according to the present invention, only one power supply is needed without the need to install additional power supply for driving the ion absorbing parcel to absorb the positive ions in the vacuum chamber, thereby maintaining the degree of vacuum of the chamber.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

The structure and technical features of the present invention will now be described in considerable detail with reference to some embodiments and the accompanying drawings thereof, so that the present invention can be easily understood.

Figure 1:
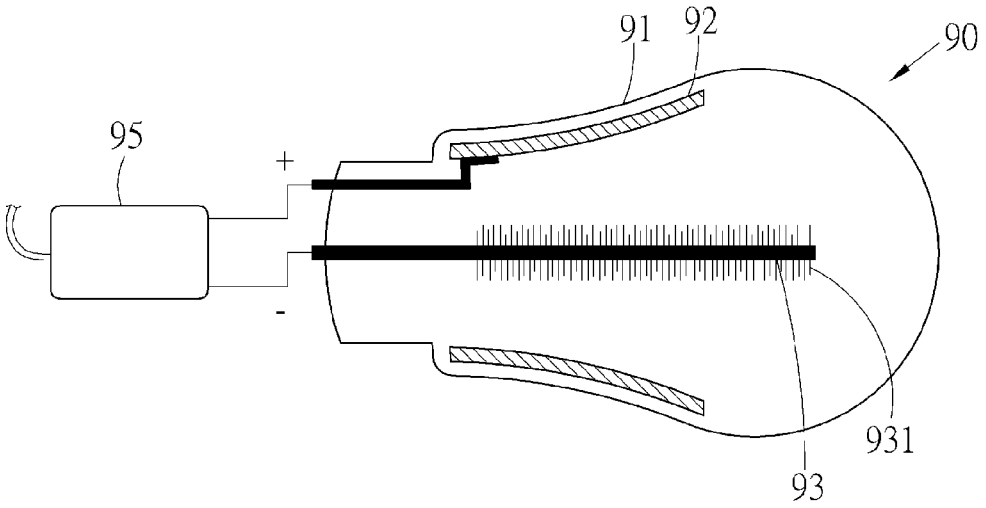
FIG. 1 (PRIOR ART)
FIG. 1 is a schematic diagram showing a conventional field emission light.
Figure 2:
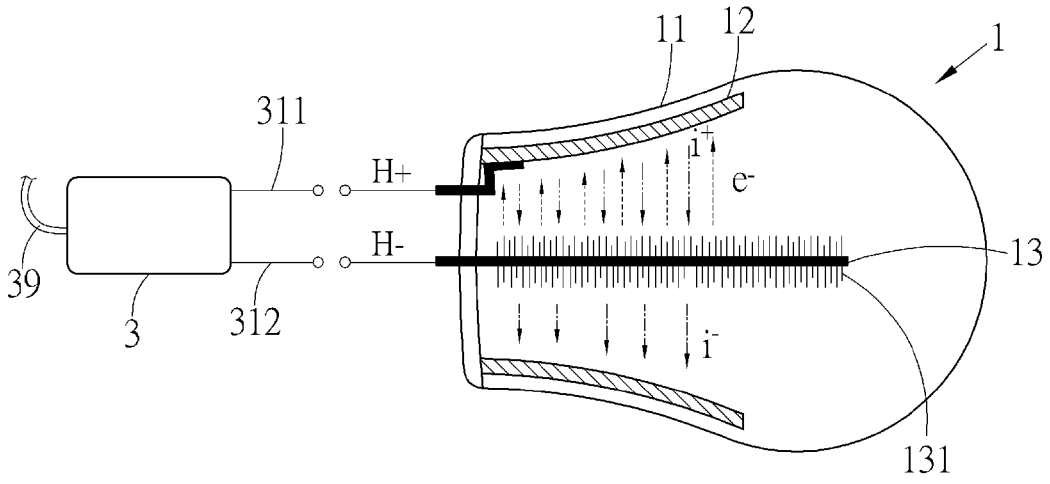
FIG. 2 is a schematic diagram showing the motion of electrons and ions in a field emission light.

Referring to FIG. 2, which is a schematic diagram showing the motion of electrons and ions in a field emission light, a field emission light 1 comprises a field emission cathode 13 and a field emission anode 12 packaged in a glass vacuum chamber 11, and a power supply 3 for applying voltage and current and establishing an electric field between the field emission cathode 13 and field emission anode 12. An input power source 39 into the power supply 3 is transformed and boosted, then power out through a positive pole 311 and a negative pole 312 thereof, respectively, to an anode terminal $H_+$ of a field emission anode 12, and a cathode terminal H− of the field emission cathode 13, respectively, thereby constituting a electrically connection between the power supply 3 and the field emission anode 12 (the field emission cathode 13, respectively).

The principle of field emission lighting is based on a quantum tunneling effect performed by the field emission cathode 13 in an electric field; while a proper electric potential provided by the power supply 3 is applied to the field emission cathode 13 and the field emission anode 12, the vacuum level around the surface of the field emission cathode 13 will be reduced and so that electrons $e^-$ will be emitted, and these electrons $e^-$ will then collide with a phosphor layer on the field emission anode 12 thereby generating light. Field emission principle is: when no electric field E is present (E=0), the surface electrons of the field emission cathode 13 requires a sufficient energy that is greater than $q\phi$ to have a chance for overcoming a potential barrier, thereby emitting the electron $e^-$ from the surface of the field emission cathode 13, wherein q represents a electronic electricity, and $\phi$ represents a potential difference, which is the difference value between the vacuum energy level and the Fermi energy level, as description by the known Fowler-Nordheim equation. But when the power supply 3 applies voltage to establish an electric field (E>0), a potential distribution in a vacuum zone is changed so that the potential barrier that the electrons $e^-$ should overcome for tunneling gets smaller, thereby the electrons $e^-$ can have a greater chance for directly tunneling through the potential barrier to reach the outside of field emission cathode 13. While the greater the applied electric field, the smaller the potential barrier is, thereby the electron $e^-$ having a greater probability to tunnel and then escape.

Based on the Fowler-Nordheim equation of the field emission principle, field emission current relates to of the work function of surface material of the field emission cathode 13, the electric field and the field enhancement factor; the lower the work function of the surface materials of the field emission cathode 13; the more easily the electrons are emitted from the surface of the field emission cathode 13. Likewise, the greater the electric field is, the more easily the electrons are emitted from the surface of the field emission cathode 13. In recent years, since conductive nano materials have large aspect ratio, high temperature resistant and other characteristics, they can reduce the work function of field emission cathode 13 so as to be considered to be an appropriate nano emission component 131. Common nano emission component 131 is like carbon nano materials, nano diamond-like carbon, and nanoscale metals.

As shown in FIG. 2, when the electric field of the field emission light is established, if ions exist in the electric field, they may cause ion bombardment that make severe effect due to the formation of plasma in the electric field. Plasma is a kind of partially ionized gases, after applying voltages to the field emission cathode 13 and the field emission anode 12, when the ionized gases reach a certain concentration, the gases in the electric field, on the surface of the field emission cathode 13 and the field emission anode 12 are bombarded by the electron $e^-$, thereby forming secondary ions including positive ions $i^+$ and negative ions $i^-$ respectively. In the electric field, the positive ion $i^+$ and the negative ion $i^-$ will obtain enough energy to continuously bombard the gases in the field or the field emission cathode 13 and the field emission anode 12, which results in reactions like dissociation, ionization and excitation and thereby generating more ions, atom, and radicals. Particularly, bombarded by the positive ions on the surface of the field emission cathode 13 will damage the nano emission component, thereby reducing the half-life of the field emission light 1.

When the field emission light 1 adopts nanomaterial in a field emission cathode 13, due to the large surface area provided by the nanomaterials, the nanomaterial will rapidly absorbs moisture, oxygen, nitrogen, etc. once it exposed to air. In order to make the vacuum of the glass chamber 11 lower than $10^{-5}$ or $10^{-6}$ torr, during the packaging process of the light emission light 1, a high order vacuum machine is used to vacuum the glass chamber 11; however, the lower the vacuum, the lower the pressure is, thereby causing the moisture congealed to solid that can't be evacuated. When the power supply 3 of the field emission light 1 applies voltage to the field emission cathode 13 and the field emission anode 12 to establish an electric field, the field emission cathode 13 will emit electrons, which results in raising the temperature of the field emission cathode 13, thereby releasing the water molecules, oxygen, nitrogen and so on, namely the phenomenon of outgas of the field emission cathode 13. Further, the field emission anode 12 includes a conductive layer and a phosphor layer, in which the phosphor layer includes a mixture of phosphor powder and bonding material for coating and fixing on the conductive layer. The bonding material can be organic material or inorganic material. When the power supply 3 of the field emission light 1 applies voltage to the field emission cathode 13 and the field emission anode 12 to establish an electric field, the field emission cathode 13 will emit electrons toward the field emission anode 12. Once the field emission anode 12 bombarded by the electrons, the temperature of the field emission anode 12 rises and water molecule, oxygen, silicon, metal, etc. in the bonding material or the conductive material released, namely phenomenon of outgas of the field emission anode 13.

Table 1 shows an element analysis of the surface of the field emission cathode of a conventional field emission light after 12 hours treatment with different electric fields having different voltages.

TABLE I

An element analysis table of the surface of the field emission cathode after 12 hours treatment with different voltages, the unit is %.

| Voltage | C | O | Na | Si | S | Zn |
|---|---|---|---|---|---|---|
| 1000 V | 85.29 | 4.87 | 1.96 | 1.88 | 5.04 | 0.95 |
| 2000 V | 82.84 | 4.13 | 1.83 | 1.79 | 7.59 | 1.83 |
| 3000 V | 82.69 | 3.08 | 1.17 | 1.17 | 9.70 | 2.19 |

As shown in Table I, after 12 hours treatment with 1000V, the surface of the field emission cathode suffered an low degree of ion bombardment, which is verified by detecting the elements O, Na, Si, S, Zn on the surface of the field emission cathode 13 that are not belong to. When a stronger voltage (represented by 3000 V) is applied, an amount of the carbon nanotube at the surface of the field emission cathode 13 decreases due to damage by the ion bombardment; the lower moisture content (estimated from the element O) compared to the moisture content as treatment with 1000V revealed that moisture released out of surface of the field emission cathode caused by the higher temperature induced by the higher voltage and the ion bombardment. In detail, the elements Si, S, Zn detected at the surface of the field emission cathode because the field emission anode including the phosphor power (mainly consisting of ZnS) and the bonding material (containing Si) was bombarded by the ions $e^-$ in the electric field, resulting in releasing the elements Si, S, Zn and forming the ionizing positive ions, thereby causing the phenomenon of ion bombardment on the field emission cathode 13.

TABLE II

An element analysis table of the surface of the field emission anode 12 after 12 hours treatment with different voltages, the unit is %.

| Voltage | O | S | Zn |
|---|---|---|---|
| 1000 V | 34.50 | 36.72 | 17.42 |
| 2000 V | 28.55 | 43.10 | 16.78 |
| 3000 V | 26.53 | 47.37 | 14.76 |

As shown in Table II, after 12 hours treatment with 1000V, the surface of the field emission anode 12 suffered a electron ($e^-$) bombardment and a negative ion ($i^-$) bombardment, which is verified by reduction of the elements O, S, Zn contents on the surface of the field emission anode 12. When a stronger voltage (represented by 3000 V) is applied, the effect of the ion bombardment is stronger, thereby the contents of these substances on the field emission anode 12 getting lower. These substances released into the glass vacuum chamber 11 can form the ionizing positive ions that bombard on the field emission cathode 13, such that the elements O, S, Zn and so on can be detected at the surface of the field emission cathode 13. Therefore, by these analysis can reveal that ion bombardment is one of the factors reduces the lifetime of the field emission light 1.

To further illustrate the field emission cathode 13 and the field emission light 1 using the same according to the present invention, some embodiments is listed below, but is not limited thereto.

Figure 3:
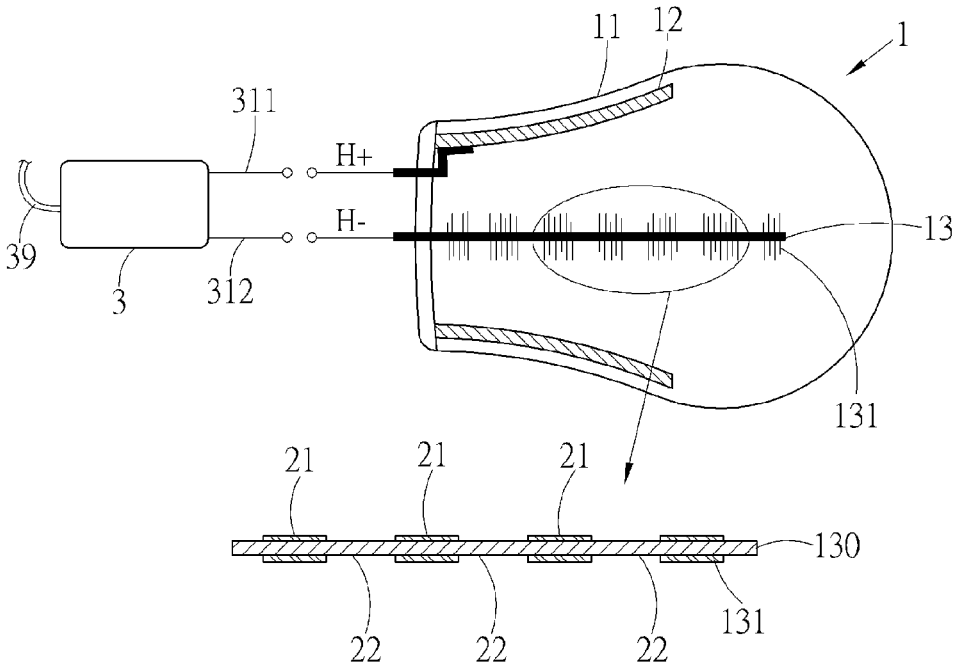
FIG. 3 is a schematic diagram showing a field emission cathode and a field emission light using the same according to the present disclosure.

Refer to FIG. 3, which is a schematic diagram showing a field emission cathode 13 and a field emission light 1 using the same according to the present disclosure. The field emission cathode 13 mainly applied for a luminaire based on the field emission theory, such as a field emission light bulb (FEL bulb), a field emission light tube (FEL tube), a field emission light panel (FEL panel), or a field emission display (FED), etc. Although FIG. 3 only shows a FEL bulb for example, a person skilled in the art shall realize the same technical concept can be used in the aforementioned luminaire, but is not limited thereto.

As shown in FIG. 3, the field emission cathode 13 comprises a plurality of electron emitting parcels 21, and a plurality of ion absorbing parcels 22, in which each of the at least one electron emitting parcel 21 is electrically connected with each of the at least one ion absorbing parcel 22. The plurality of electron emitting parcel 21 separated from each other with a space are disposed on a cathode substrate 130, and each electron emitting parcel 21 is adjacent to more than one of the ion absorbing parcels 22, respectively (shown as FIG. 6).

The cathode substrate 130 can be conductive material like metal, or can be dielectric material with a conductive layer formed thereon, in which the conductive layer can be a conductive metal layer formed by coating, electroplating or electroless plating means. In practice, the cathode substrate 130 made of dielectric material can be a silicon substrate, a glass substrate, an alumina ceramic substrate, an ITO-sputtered substrate; the cathode substrate 130 made of metal can be a iron-nickel alloy substrate, a iron-cobalt-nickel alloy substrate, a nickel substrate, a nickel-copper substrate, a copper substrate, a noble metal substrate, a copper alloy substrate, electroless plating or nickel-metal-doped silicon material substrate, electroless plating or nickel-metal-doped glass substrate, electroless plating or nickel-metal-doped alumina ceramic substrate, etc., but the scope of claims of the present invention should not be limited to those.

Figure 4:
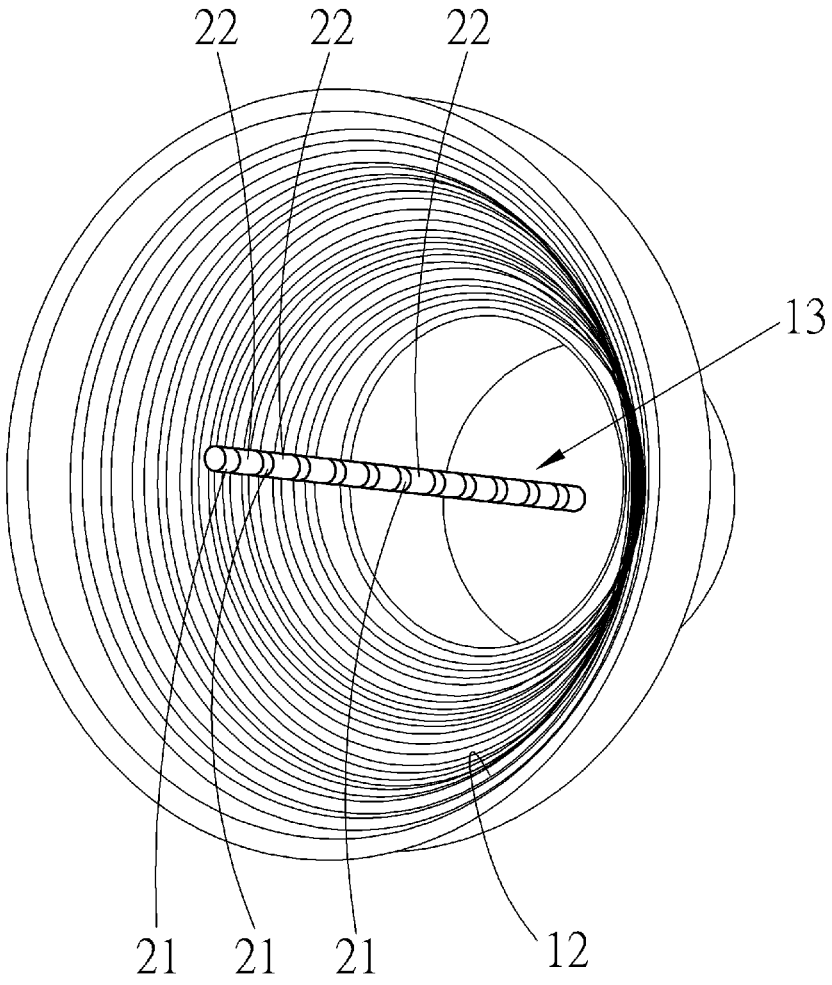
FIG. 4 is a schematic diagram showing the position of a field emission cathode in a FEL bulb of the present disclosure.
Figure 6:
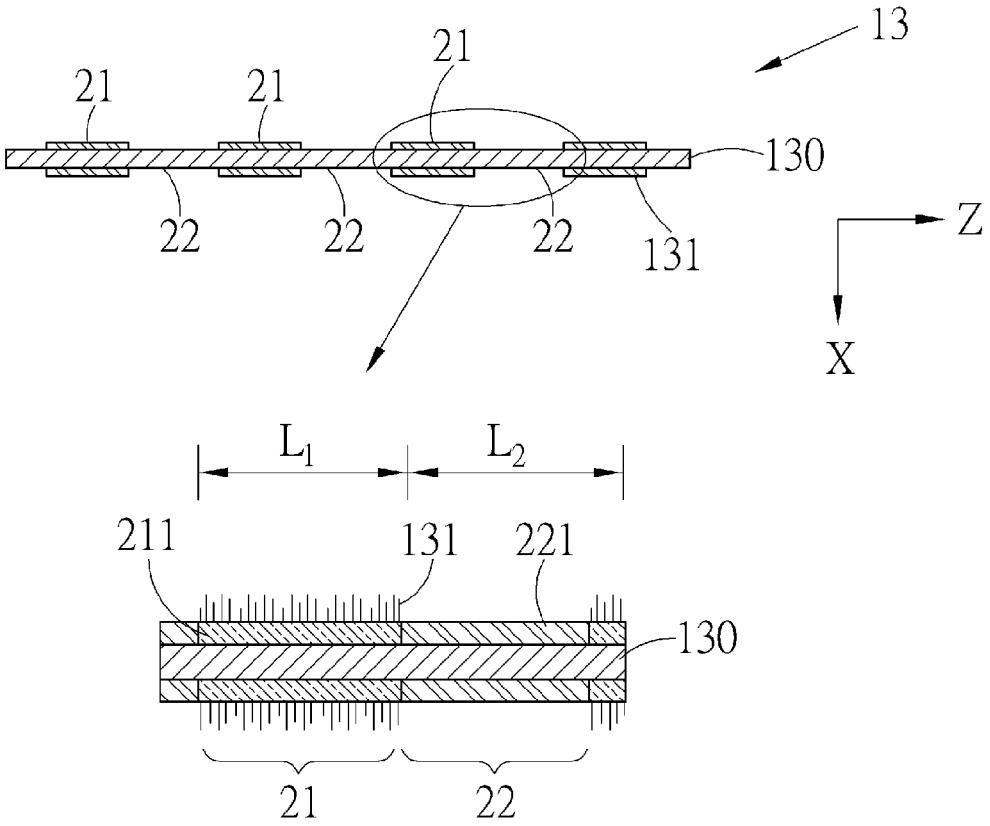
FIG. 6 is a schematic diagram showing a first embodiment according to the present disclosure.

Refer to FIG. 3 and FIG. 4 and FIG. 6, in which FIG. 4 is a schematic diagram showing the position of a field emission cathode in a FEL bulb of the present disclosure; FIG. 6 is a schematic diagram showing a first embodiment according to the present disclosure. As shown in FIG. 4, a FEL bulb includes the field emission anode 12 deposed on the interior of the glass chamber, and the field emission cathode 13 disposed at the center thereof. Every two ion absorbing parcels 22 are spaced each other with the gap and one of the electron emitting parcels 21 inserts between the gap, that is, the field emission cathode 13 has sub-sections defined by the each of separated electron emitting parcels 21 and each of the separated ion absorbing parcels 22 connected together.

The electron emitting parcels 21 includes a conductive first substrate 211 formed on the cathode substrate 130 made of metal conductive material, and a nano emission component 131 formed on the first substrate 211 by coating, laying or germinating means for emitting electrons in an electric field of the field emission light 1. In the following embodiments, the nano emission component 131 is nanomaterial formed by, but is not limited to, a thermal chemical vapor deposition (TVCD) method, mainly including carbon nano tube, and small part of single-wall CNT, carbon nano fiber (CNF) and other possible carbon nano structures.

The ion absorbing parcel 22 is constituted by a second substrate 221 made of a conductive material. In order to use the ion absorbing parcel 22 to absorb positive ions in the electric field, the electric conductivity of the first substrate 211 is less than the electric conductivity of the second substrate 221. As the electron emitting parcel 21 and the ion absorbing parcel 22 are electrically connected each other, the field emission cathode 13 is at a negative potential relative to the field emission anode 12 in the electric field, in which a surface voltage of the electron emitting parcel 21 is slightly higher than a surface electron emitting parcel electron emitting parcel photovoltage of the ion absorbing parcel 22. For example, the surface voltage of the electron emitting parcel 21 relative to the field emission anode 12 may be −5,000 V; and the surface voltage of the ion absorbing parcel 22 relative to the field emission anode 12 may be −5,050 V. For applications using different material, the surface voltage of the electron emitting parcel 21 relative to the field emission anode 12 and the surface voltage of the ion absorbing parcel 22 relative to the field emission anode 12 can be different values. Therefore, ionizing positive ions $i^+$ in the electric field will be absorbed by and bombard on the ion absorbing parcel 22 preferentially, thereby preventing the electron emitting parcel 21 being bombarded by the ionizing positive ions $i^+$, and reducing the ionizing positive ions $i^+$ damaging the nano emission components 131.

Figure 5:
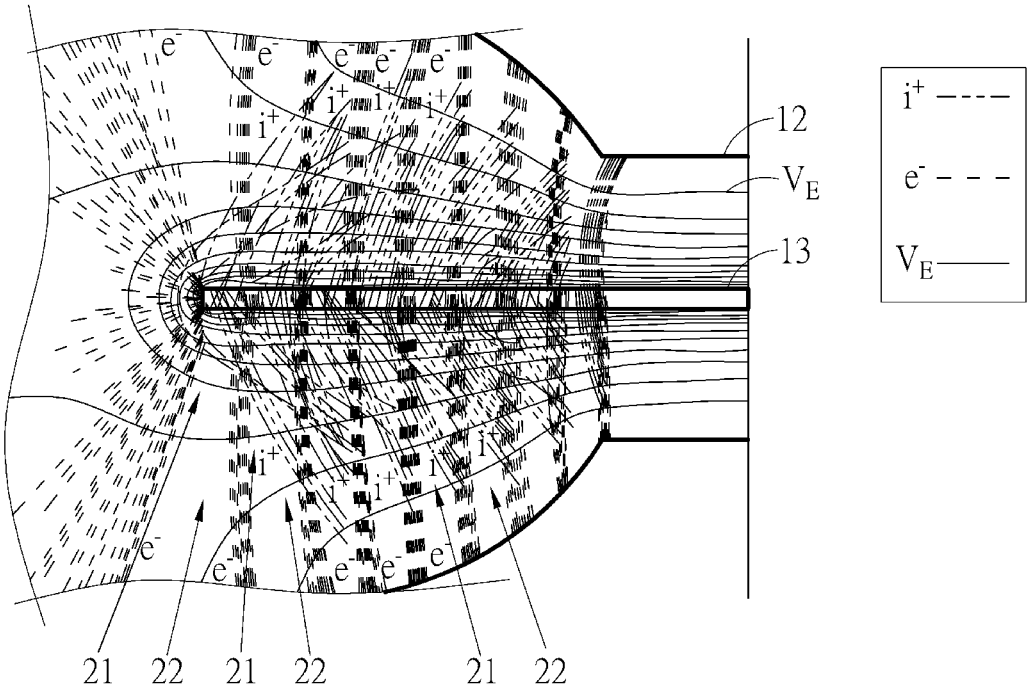
FIG. 5 is a schematic diagram showing the motion path of electrons and the positive ions according to the present disclosure.

Refer to FIG. 3 and FIG. 5, in which FIG. 5 is a schematic diagram showing the motion path of electrons $e^-$ and the positive ions $i^+$ according to the present disclosure. When the power supply 3 of the field emission light 1 applies enough voltage to the field emission cathode 13 and the field emission anode 12, respectively, the electron emitting parcel 21 of the field emission cathode 13 will generate a quantum tunneling effect, such that the nano emission components 131 of the electron emitting parcel 21 emits electrons $e^-$, in which a path of the electrons $e^-$ represented by dash line (- - - - -) in FIG. 5. Because the electrons $e^-$ carry negative charges, they are attracted by and then bombard on the phosphor layer on the field emission anode 12 through a vacuum gap, thereby emitting light. In FIG. 5, to make it easier to understand drawings and description, it only shows the electrons $e^-$ bombard on the field emission anode 12 thereby generating the ionizing positive ions $i^+$, but the ionizing positive ions $i^+$ may also be formed due to the electrons $e^-$ bombard on the substance in the electric field during the movement of electrons $e^-$.

As shown in FIG. 5, both of the ion absorbing parcels 22 and the electron emitting parcels 21 are arranged in a spaced manner, respectively, and the ion absorbing parcels 22 are spaced and adjacent to the electron emitting parcels 21. Because the electric conductivity of the first substrate 211 is less than the electric conductivity of the second substrate 221, when the power supply 3 applies a negative voltage to the field emission cathode 13 through a negative pole 312 of the power supply 3, and applies a positive voltage to the field emission anode 12 through a positive pole 311 of the power supply 3, a surface voltage of the ion absorbing parcel 22 is less than a surface voltage of the electron emitting parcel 21. For example, the surface voltage of the electron emitting parcel 21 relative to the field emission anode 12 may be −5,000 V; and the surface voltage of the ion absorbing parcel 22 relative to the field emission anode 12 may be −5,050 V. That is, the difference between the surface voltage of the ion absorbing parcel 22 and the surface voltage of the electron emitting parcel 21 may be −50 V, but is not limited thereto. Since difference between the surface voltage of the ion absorbing parcel 22 and the surface voltage of the field emission anode 12 is higher, the ionizing positive ions $i^+$ in the electric field will be abstracted by and move toward the ion absorbing parcel 22 along a perpendicular direction of an equal voltage profile $V_E$. The movement path of the ionizing positive ions $i^+$ is represented as a chain line (— • • — • • —) in FIG. 5. Most of the ionizing positive ions $i^+$ is adsorbed by the ion absorbing parcel 22 as its negative potential, thereby being converted to element adhered on the ionizing positive ions $i^+$. Therefore, the outgas generated by the field emission cathode 13 and the field emission anode 12, and the ionizing positive ions $i^+$ resulting from the ion bombardment can adsorb on the ion absorbing parcel 22, thereby reducing the amount of the ionizing positive ions $i^+$, reducing the ionizing positive ions $i^+$ damaging the nano emission components 131, and maintaining the degree of vacuum and half-life of the field emission light 1.

In order to improve the absorption effect of the ion absorbing parcel 22 for the ionizing positive ions $i^+$, both of the ion absorbing parcels 22 and the electron emitting parcels 21 are arranged in a spaced manner, respectively. Since the electric conductivity of the first substrate 211 of the electron emitting parcels 21 is less than the electric conductivity of the second substrate 221 of the ion absorbing parcel 22, in order to achieve a better electrical effect, the first substrate 211 can be a conductive material with lower electric conductivity selected from a group consisted of chromium oxide, conductive ceramic, passivated treatment stainless steel, graphite, diamond-like carbon or combinations thereof. The second substrate material can be selected from a group consisted of chromium carbide, nickel, noble metal (such as silver, gold, palladium, and platinum), alloy containing iron and nickel (such as iron-cobalt-nickel alloy, and stainless steel), copper or combinations thereof. The manufacturing methods of the first substrate 211 and the second substrate 221 are disclosed in the subsequent embodiments.

As shown in FIG. 6, an axis of the axial direction of the field emission cathode 13 is Z direction which is ideally parallel with the field emission anode 12, and an emission direction of the electrons (radial direction) is X direction. To achieve a better lighting effect, the surface area of the ion absorbing parcel 22 should not larger than the surface area of the electron emitting parcels 21 in the X direction to prevent improper reduction of the amount of the electrons provided from the electron emitting parcels 21. In other words, in the X direction, a cross-section length $L_2$ of each of the ion absorbing parcel 22 is less than or equal to a cross-section length $L_1$ of the electron emitting parcel 21 adjacent to the corresponding ion absorbing parcel 22.

The elements of the electron emitting parcel 21 and the ion absorbing parcel 22 and the methods thereof, respectively are disclosed in the following embodiments for example, but are not limited thereto.

First Embodiment

Please refer to FIG. 6, which is a schematic diagram showing the electron emitting parcel 21 and the ion absorbing parcel 22 according to the present disclosure. In this embodiment, a cross-section length $L_2$ of each of the ion absorbing parcel 22 is substantially equal to a cross-section length $L_1$ of the electron emitting parcel 21.

In this embodiment, the cathode substrate 130 is made of iron-cobalt-nickel alloy (one kind of stainless steel) of a conductive metal material, but is not limited to. The manufacturing method of the field emission cathode 13 is listed below:

(1) Treat the cathode substrate 130 having a metal-filamentous form with a chemical passivation process, such that a passivation layer is coated on the cathode substrate 130, in which the electric conductivity of the passivation layer is less than the electric conductivity of the untreated cathode substrate 130. The passivation layer constitutes a first substrate 211.

(2) Selectively treat the first substrate 211 with a sandblast process including treatment regions each with length $L_2$ separated by a untreatment gap $L_1$ to remove partial of the passivation layer with each section having length $L_2$, such that a second substrate 221 with length $L_2$ is constituted, in which adjacent ones of the second substrates 221 and the first substrates 211 are separated by each other.

(3) Shield the second substrates 221 using a high-temperature-resistant substance, then adopt a thermal chemical vapor deposition, TCVD method to germinate a carbon nano material for forming a nano emission component 131 on the first substrate 211.

(4) Strip the high-temperature-resistant substance on the second substrate 221 to expose the second substrate 221, thereby forming electron emitting parcels 21 each with length $L_1$ and ion absorbing parcel 22 each with length $L_2$ separate by each other to arrange in a spaced manner. The first substrate 211 of the electron emitting parcel 21 is the passivated iron-cobalt-nickel alloy with a lower electric conductivity compared to the iron-cobalt-nickel alloy exposed by the sandblast process that constitutes the second substrate 221 of the ion absorbing parcel 22.

For different applications, the cathode substrate 130 can be made of a conductive material, as disclosed in the step (1). The cathode substrate 130 having a metal-filamentous form is coated with a chromium oxide layer with lower electric conductivity than the electric conductivity of the conductive material of the original cathode substrate 130, that is, the chromium oxide layer constitutes the first substrate 211. Next, the first substrate 211 is selectively treated with a sandblast process including treatment regions each with length $L_2$ separated by a untreatment gap $L_1$, such that a second substrate 221 with length $L_2$ is constituted, in which adjacent ones of the second substrates 221 and the first substrates 211 are separated by each other.

Similarly, for different applications, the cathode substrate 130 can be made of a conductive material, which is previously coated with a conductive ceramic, graphite, diamond-like carbon and other conductive materials with lower electric conductivity to constitute the first substrate 211, and then the lower conductive material on the cathode substrate 130 is partially removed by a mechanical or chemical means to expose partial of the original cathode substrate 130 with each section having a length $L_2$ to constitute the second substrate 221.

Second Embodiment

Figure 7:
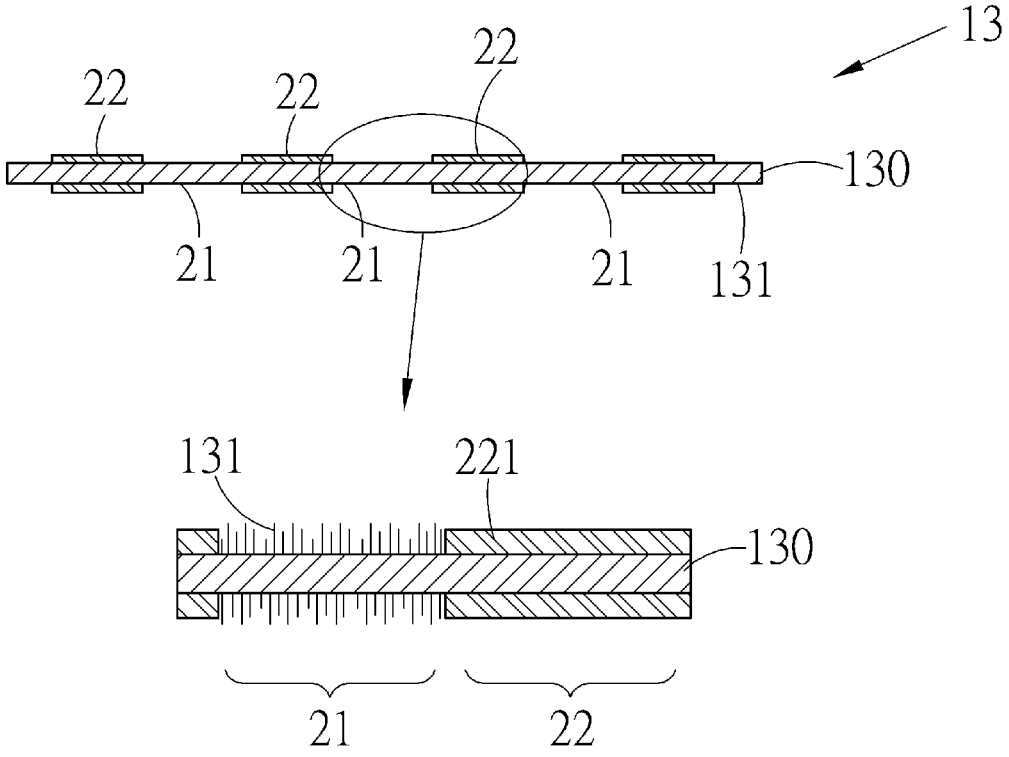
FIG. 7 is a schematic diagram showing a second embodiment according to the present disclosure.

Please refer to the FIG. 7, which is a schematic diagram showing the electron emitting parcel 21 and the ion absorbing parcel 22 according to the present disclosure. In this embodiment, the cathode substrate 130 is made by a substrate with lower electric conductivity, such as ferrous metals, conductive ceramics, graphite, diamond-like carbon and so on, but is not limited thereto. The manufacturing method of the field emission cathode 13 is listed below:

(1) Shield sections of the cathode substrate 130 which are arranged non-continuously with a resist or a non-metallic material to constitute the first substrate 211, in which the length of each parcel is $L_1$. Following, treat the cathode substrate 130 with a electroplating or electroless plating process to plate chromium carbide, nickel, noble metal, or copper or other material having higher electric conductivity on the unshielded sections of the cathode substrate 130 to constitute the second substrate 221, in which the length of each unshielded section is $L_2$.

(2) Shield the second substrates 221 using a high-temperature-resistant substance, and then adopt a TCVD method to germinate a carbon nano material for forming a nano emission component 131 on the first substrate 211.

(3) Strip the high-temperature-resistant substance on the second substrate 221 to expose the second substrate 221, thereby forming the electron emitting parcels 21 each with length $L_1$ and the ion absorbing parcel 22 each with length $L_2$ separate by each other to arrange in a spaced manner. The first substrate 211 of the electron emitting parcel 21 is constituted by ferrous metals, conductive ceramics, graphite, diamond-like carbon and other material with lower electric conductivity compared to the electric conductivity of material such as chromium carbide, nickel, noble metal (such as silver, gold, palladium, platinum), or copper and so on of the second substrate 221 of the ion absorbing parcel 22.

Third Embodiment

Figure 8:
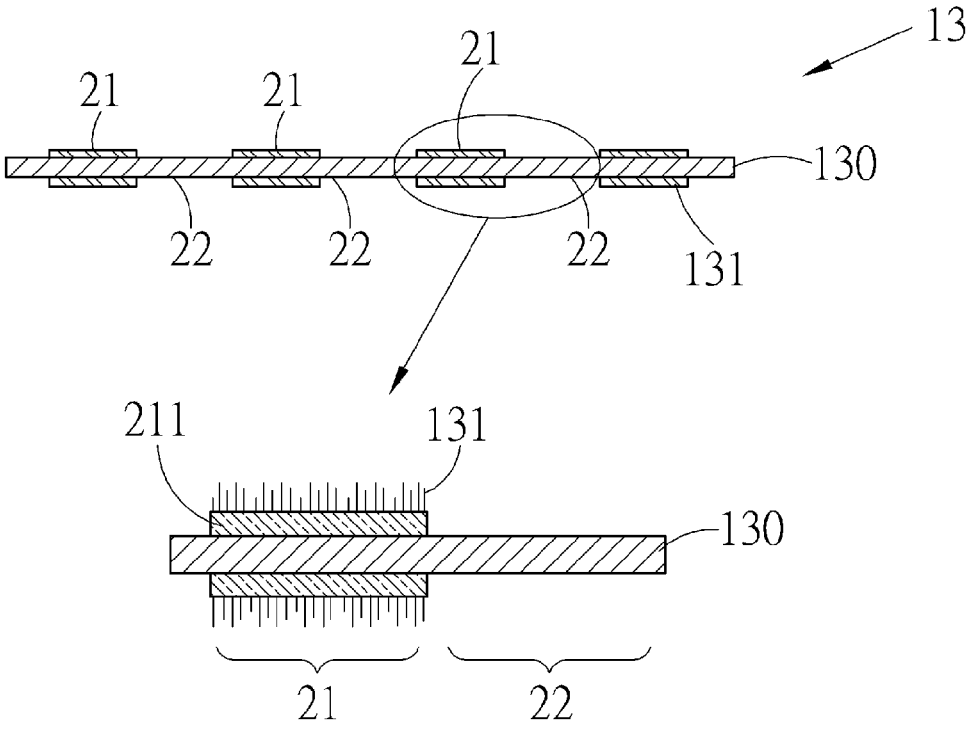
FIG. 8 is a schematic diagram showing a third embodiment according to the present disclosure.

Please refer to the FIG. 8, which is a schematic diagram showing the electron emitting parcel 21 and the ion absorbing parcel 22 according to the present disclosure. In this embodiment, the cathode substrate 130 includes material with higher electric conductivity selected from the group consisted of chromium carbide, nickel, noble metal (such as silver, gold, palladium, and platinum), alloy containing iron and nickel (such as iron-cobalt-nickel alloy, and stainless steel), copper or combinations thereof, in which the material with higher electric conductivity is plated by a electroplating or electroless plating means on a metallic or non-metallic base substrate, or the material with higher electric conductivity itself constitutes the cathode substrate 130. The manufacturing method of the field emission cathode 13 is listed below:

(1) Shield sections of the cathode substrate 130 being the second substrate 221 which the shield are arranged non-continuously with a high-temperature-resistant substance, in which the length of each section is $L_2$. Following, treat the cathode substrate 130 with a electroplating or electroless plating process to plate ferrous metals, conductive ceramics, graphite, diamond-like carbon and other material with lower electric conductivity on the unshielded sections of the cathode substrate 130 to constitute the first substrate 211, in which the length of each unshielded section is $L_1$.

(2) Adopt a TCVD method to germinate a carbon nano material for forming a nano emission component 131 on the first substrate 211.

(3) Strip the high-temperature-resistant substance on the second substrate 221 to expose the second substrate 221, thereby forming the electron emitting parcels 21 each with length $L_1$ and the ion absorbing parcel 22 each with length $L_2$ separate by each other to arrange in spaced manner. The first substrate 211 of the electron emitting parcel 21 is constituted by ferrous metals, conductive ceramics, graphite, diamond-like carbon and other material with lower electric conductivity compared to the electric conductivity of material such as chromium carbide, nickel, noble metal (such as silver, gold, palladium, platinum), or copper and so on of the second substrate 221 of the ion absorbing parcel 22.

Fourth Embodiment

Figure 9:
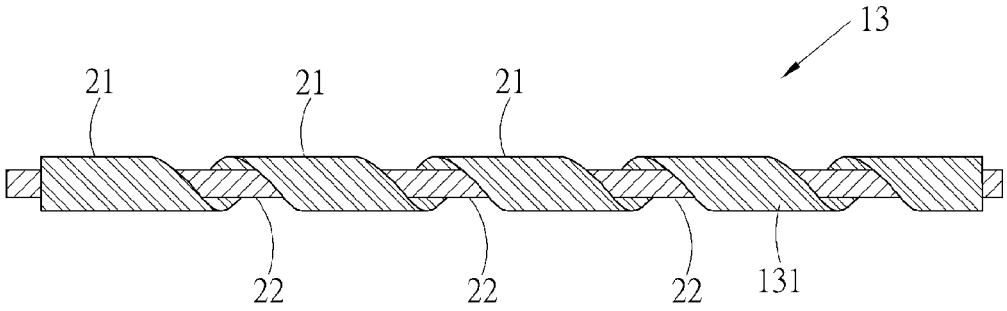
FIG. 9 is a schematic diagram showing a fourth embodiment according to the present disclosure.

Please refer to FIG. 9, which is a schematic diagram showing the electron emitting parcel 21 and the ion absorbing parcel 22 according to the present disclosure. The manufacturing method of the field emission cathode 13 is similar to the first embodiment to the third embodiment, but the stripping step or shielding step with a non-continuously spaced manner in this embodiment is replaced by a stripping step or shielding step with a continuously spiral path manner, thereby forming a spiral electron emitting parcel 21 and a ion absorbing parcel 22 spiral around each other, but the present invention is not limited to. Any structure showing a cross-section length $L_2$ of each of the ion absorbing parcel 22 is less than or equal to a cross-section length $L_1$ of the electron emitting parcel 21 adjacent to the corresponding ion absorbing parcel 22 in the X direction, is the concept of the present invention what the applicant is claimed for.

Fifth Embodiment

Figure 10:
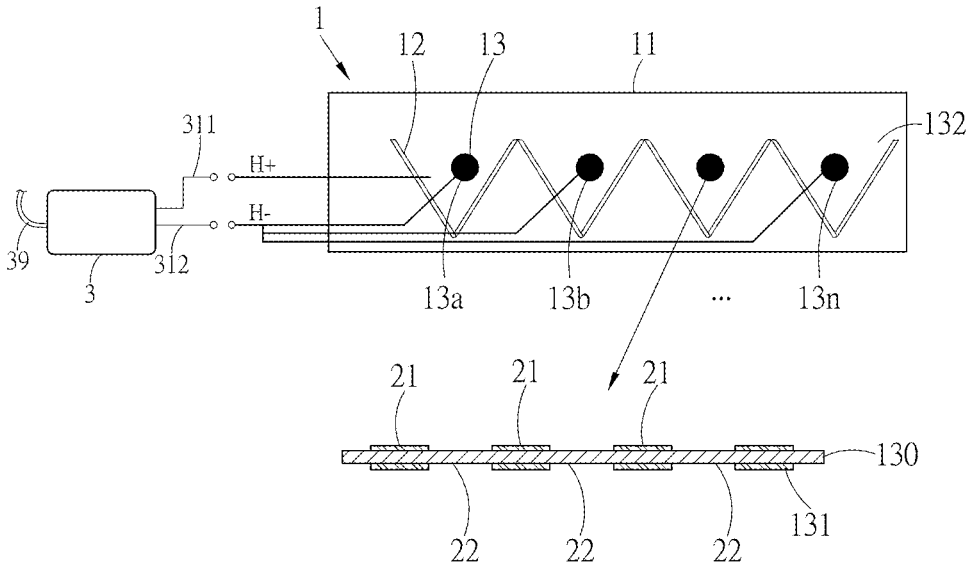
FIG. 10 is a schematic diagram showing a flat panel-type of a field emission light according to the present disclosure.

Please refer to FIG. 10, which is a schematic diagram showing a flat panel-type of a field emission light according to the present disclosure.

In this embodiment, the field emission anode 12 is a aluminum punched plate having a plurality of consecutive recesses 132, in which each of consecutive recesses 132 may be constituted by, but is not limited to, a paraboloid or two non-parallel planes having a included angle ranged of 60~120° therebetween to form a "W-shape" surface (as shown in FIG. 10). In this embodiment, the field emission anode 12 is fixed in the glass vacuum chamber 11; a phosphor layer is coated by brushing on a surface of the interior of each of consecutive recesses 132 of the field emission anode 12.

Each of a plurality of field emission cathodes 13*a*, 13*b*, . . . 13*n* is disposed in each of recesses 132 of the field emission anode 12 are electrically connected to the cathode terminal $H^-$ for receiving power input. The field emission cathode 13, the field emission anode 12 are packaged in the glass vacuum chamber 11, and are electrically connected to the negative pole 312 and the positive pole 311 of the power supply 3, respectively.

Each cathode substrate 130 of each field emission cathode 13*a*, 13*b*, . . . 13*n* is made of stainless steel wire. The manufacturing method of the field emission cathode 13 includes the following steps; please refer to FIG. 6 to FIG. 8 together. Each stainless steel wire is treated with an electroplating process to form a metallic ceramic layer, as chromium carbide (CrC) layer, with good electric conductivity and a property of anti-corrosion thereon. Next, sections of the cathode substrate 130, each with length $L_2$, that are separated by a length $L_1$ are shielded by glass sleeves respectively, in which each shielded section defines the second substrate 221, and each exposed section with the length $L_1$ defines the first substrate 211. Following, the exposed sections of the cathode substrate 130 are treated with a sandblast process to remove the chromium carbide layer and expose the base material of the cathode substrate 130, which is stainless steel. The cathode substrate 130 is then treated with a chemical treatment to passivate the exposed stainless steel, thereby constituting the first substrate 211. Each glass sleeve is consisted of two semicylindrical sub-sleeves each having the length $L_2$, in which the two semicylindrical sub-sleeves can interlock with each other to shield the second substrate 221 of the cathode substrate 130.

A TCVD method is adopted to germinate a carbon nano material for forming a nano emission component 131 on the first substrate 211; and then the glass sleeves shielded on the second substrate 221 are stripped, thereby forming the electron emitting parcels 21 each with length $L_1$ and the ion absorbing parcel 22 each with length $L_2$ separate by each other to arrange in spaced manner. The first substrate 211 of the electron emitting parcel 21 is constituted by the passivated treatment stainless steel with lower electric conductivity compared to the electric conductivity of the chromium carbide plating layer on the second substrate 221 of the ion absorbing parcel 22.

Each of the plurality of field emission cathodes 13*a*, 13*b*, . . . 13*n* may be substantially disposed in a center region of each of recesses 132 of the field emission anode 12. Therefore, when each of the plurality of field emission cathodes 13*a*, 13*b*, . . . 13*n* emits electrons, the positive ion is absorbed by the ion absorbing parcel 22, thereby maintaining the degree of the vacuum chamber of the field emission light 1, reducing the phenomenon of ion bombardment, and increasing the lifetime of the field emission light 1.

Therefore, the spirit and scope of the appended claims should not be limited to the description of the embodiments contained herein. It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims.

What is claimed is:

1. A field emission cathode applied for a field emission light, the field emission cathode comprising: at least one electron emitting parcel, and at least one ion absorbing parcel each being electrically connected with each of the at least one electron emitting parcel;

wherein each of the electron emitting parcel includes a first substrate and a nano emission component being a nanomaterial and on the first substrate for emitting electrons in an electric field of the field emission light;

wherein each of the ion absorbing parcel constituted by a second substrate;

wherein the electric conductivity of the first substrate is less than the electric conductivity of the second substrate.

2. The field emission cathode according to claim 1, wherein the at least one ion absorbing parcel is spaced and adjacent to the at least one electron emitting parcel each other, is deposed in spiral around each other or a combination thereof.

3. The field emission cathode according to claim 1, wherein the first substrate includes material being chromium oxide, conductive ceramic, passivated stainless steel, graphite, diamond-like carbon or combinations thereof.

4. The field emission cathode according to claim 1, wherein the second substrate includes material being chromium carbide, nickel, noble metal, iron-nickel alloy, copper or combinations thereof.

5. The field emission cathode according to claim 1, wherein in an emission direction of the electrons, a cross-section length of each of the ion absorbing parcel is less than or equal to a cross-section length of the electron emitting parcel adjacent to the corresponding ion absorbing parcel.

6. A field emission light, comprising a field emission cathode according to claim 1, a field emission anode and a power supply, wherein the field emission cathode and the field emission anode are packaged in a glass vacuum chamber;

wherein a positive pole of the power supply is connected with the field emission anode, and a negative pole of the power supply is connected with the field emission cathode, therefor supplying power;

wherein the surface voltage of the ion absorbing parcel of the field emission cathode is less than the surface voltage of the electron emitting parcel of the field emission cathode;

wherein the ion absorbing parcel absorbs ionizing positive ions in the glass vacuum chamber when a electric field is provided between the field emission cathode and the field emission anode.

7. The field emission light according to claim 6, wherein in an emission direction of the electrons from a field emission cathode, a cross-section length of each of the ion absorbing parcel is less than or equal to a cross-section length of the electron emitting parcel adjacent to the corresponding ion absorbing parcel.

8. The field emission light according to claim 6, wherein the shape of the field emission light is bulb-like or tube-like.

9. The field emission light according to claim 6, wherein the field emission light has a planar shape, an amount of the field emission cathode is more than one, and the field emission anode contains a plurality of recesses each for accommodating each of the field emission cathodes.

* * * * *